US008341924B2

(12) United States Patent
Lindblad et al.

(10) Patent No.: US 8,341,924 B2
(45) Date of Patent: Jan. 1, 2013

(54) METHOD AND AN APPARATUS FOR STERILISING PACKAGES

(75) Inventors: Ulf Lindblad, Lund (SE); Jenny Karolina Olsson, Bjärred (SE)

(73) Assignee: Tetra Laval Holdings & Finance S.A., Pully (CH)

( * ) Notice: Subject to any disclaimer, the term of this patent is extended or adjusted under 35 U.S.C. 154(b) by 67 days.

(21) Appl. No.: 11/989,542

(22) PCT Filed: Jul. 13, 2006

(86) PCT No.: PCT/SE2006/000875

§ 371 (c)(1),
(2), (4) Date: Jan. 28, 2008

(87) PCT Pub. No.: WO2007/024173

PCT Pub. Date: Mar. 1, 2007

(65) Prior Publication Data

US 2009/0090086 A1 Apr. 9, 2009

(30) Foreign Application Priority Data

Aug. 23, 2005 (SE) ..... 0501873

(51) Int. Cl.
*B65B 31/04* (2006.01)
*B65B 31/00* (2006.01)

(52) U.S. Cl. ..... 53/432; 53/111 R; 53/79

(58) Field of Classification Search ..... 53/425, 53/426, 432, 111 R, 79, 141
See application file for complete search history.

(56) References Cited

U.S. PATENT DOCUMENTS

| | | | |
|---|---|---|---|
| 2,492,873 | A | 12/1949 | Lamb |
| 2,771,645 | A | 11/1956 | Martin |
| 4,595,560 | A | 6/1986 | Buchner et al. |
| 4,742,667 | A | 5/1988 | Müller et al. |
| 5,141,035 | A | 8/1992 | Nish et al. |

FOREIGN PATENT DOCUMENTS

| | | | |
|---|---|---|---|
| JP | 63-134903 | U | 9/1988 |
| JP | 64-009591 | U | 1/1989 |
| JP | 01-134003 | U | 9/1989 |
| JP | 2000-128131 | A | 5/2000 |
| JP | 2000-202388 | A | 7/2000 |

(Continued)

OTHER PUBLICATIONS

International Search Report dated Oct. 26, 2006.

(Continued)

*Primary Examiner* — Rinaldi I. Rada
*Assistant Examiner* — John Paradiso
(74) *Attorney, Agent, or Firm* — Buchanan Ingersoll & Rooney PC

(57) ABSTRACT

An apparatus and a method of supplying gas or a gas mixture to the inside of partly formed packages in a filling machine before a subsequent filling and sealing of the packages involves supplying the gas or gas mixture as at least one flow into the package via an opening in the package. The supply is made such that the at least one flow flows into the package to the inner region of the package and thereafter returns back through the opening. The method also involves temporarily catching the return flow from the package in a delimited space outside the opening, and directing the return flow out from the space in such a way that a substantially vertical flow along the outer envelope surface of the package is formed.

11 Claims, 4 Drawing Sheets

FOREIGN PATENT DOCUMENTS

| | | | |
|---|---|---|---|
| JP | 2002-502669 | | 1/2002 |
| JP | 2002-102813 | A | 4/2002 |
| WO | WO 99/40949 | A1 | 8/1999 |
| WO | WO 2004/054883 | A1 | 7/2004 |

OTHER PUBLICATIONS

English-language translation of Japanese Office Action dated Oct. 8, 2010 issued in the corresponding Japanese Patent Application No. 2008-527873.

METHOD AND AN APPARATUS FOR STERILISING PACKAGES

TECHNICAL FIELD

The present invention relates to a method and an apparatus for sterilising at least partly formed packages which are ready-to-full packages, in a filling machine. The term sterile is taken to signify in the following disclosure that the package, after sterilisation, attains a level of sterilisation which is designated commercially sterile.

More precisely, the present invention relates to a method, prior to filling of such packages, of treating them, including sterilising thereof in a filling machine before a subsequent aseptic filling. The packages have an open and a closed end. A first context in which a method according to the present invention may be implemented is in connection with the introductory supply, before filling of such packages, of hot air from their open end. This is put into effect in order to heat up the packages with a view, in a later sterilisation stage, to preventing the sterilisation gas which is here supplied from condensing on the walls of the package during this stage. Another manner of implementing the method is to supply sterile tempered air once the package has been gassed with sterilisation gas. The purpose here is to ventilate off previously supplied sterilisation gas. More specifically, the present invention relates to a method of supplying and removing an optional gas, hence also sterilisation gas to and from the open end of the package.

The present invention further relates to an apparatus which is included in a larger context for realising a gas sterilisation of packages in said filling machine where the larger context comprises, on the one hand, a heating zone for a heating of the material in the packages to about 70° C., and on the other hand a sterilisation zone or a combination thereof and further a ventilation zone. The sterilisation agent is intended to remain in gas form throughout the entire sterilisation stage and is intended to the greatest possible degree to be reused. For a more detailed description of one type of an apparatus and a method for producing and sterilising a package which is referable to this group, reference is made to published international application WO 2004/054883.

BACKGROUND ART

In filling machines of said type, use has previously been made of a method which entails that, during the gas sterilisation stage, a sterilisation gas is supplied centrally in conjunction with the open end of the packages. The gas or gas mixtures supplied to the package is flowing down towards the inner region of the package whereby it returns back to the opening once it reaches the inner end of the package. Today the return flow is not taken care of. It comprises sterilised gas or gas mixture which uncontrolled spreads in the surrounding chamber and may cause flows of unsterilised gas to disturb an aseptic air flow barrier disposed downstream in the filling machine, which flow barrier is required in order not to jeopardise the aseptic level attained in the sterilisation zone.

An uncontrolled return flow is also troublesome when it comes to the possibilities of reusing the gas. This is particularly important when sterilisation gas is handled. If a more directed return flow could be achieved the unintentional spreading of the sterilisation gas in the aseptic chamber can be restricted to an even greater extent than previously, and it would then be easier to reuse the gas.

Further, for the filling operation, it is an advantage if the outside of the package could also be sterilised. This would minimise the risk of re-infection as it would secure that the surrounding flow will be directed from the opening of the package and not towards it. Otherwise there is a slight, but nevertheless tangible risk that microorganisms will, in an uncontrolled manner, re-infect the sterilised surface of the inside of the package.

BRIEF SUMMARY OF THE INVENTION

One object of the present invention is to disclose a method of supplying gas or gas mixture to the inside of partly formed packages before a subsequent filling and sealing thereof is carried out, for carrying out a gas sterilisation process of both the inside and at least a part of the outside of a ready-to-fill package. More specifically, one object of the present invention is to propose a method which effectively prevents a recontamination of the package surface. Yet a further object of the present invention is to realise a method which makes for a considerably higher level of reusing as regards the supplied sterilisation gas.

The objects have been achieved by a method which comprises supplying said gas or gas mixture as at least one flow into the package via an opening in the package, the supply being made such that the at least one flow is flowing into the package to the inner region of the package and is thereafter returning back through the opening, and temporarily catching the return flow from the package in a delimited space outside the opening, and directing the return flow out from the space in such a way that a substantially vertical flow along the outer envelope surface of the package is formed. In this way also a portion of the outside of the package is treated with the gas or gas mixture. Further, the controlled direction of the gas flow improves the possibilities of reusing the gas and it minimizes the risk of recontamination of the package inside surface.

A first embodiment of the method according to the invention comprises supplying the supplied gas as a flow defined both radially outwards and inwards in relation to the package, the flow being angled in respect of the geometric major axis of the package so that the flow, when it is defined by the inner wall of the package and a return flow in the central portion of the package is positively controlled for the formation of a helical flow vortex, temporarily catching said central return flow in a space formed as a central return channel, and directing the return flow out from the space via channels in which it is rotated about 180°, divided positively and led further as a vertical flow along the outer circumferential surface of the package. In this way a considerably lower gas mass flow of the supplied gases or gas mixtures can be used as compared with the prior art. The reduced gas mass flow effectively prevents recontamination of the package surface in that the gas mass flow is clamped compared with existing solutions. Further, by a reduced gas mass flow, the unintentional spreading of the sterilisation gas in the aseptic chamber can be restricted to an even greater extent than previously. Furthermore, with a reduced gas mass flow the total economy of the process can be improved, and it provides for considerably improved possibilities of reusing the gas. This is particularly important when sterilisation gas is handled.

One additional advantage inherent in the method is that it, in addition to the sterilisation stage, may be employed both in the heating stage and in the ventilation stage. There will thereby be attained an improved heating effect, at the same time as maintenance of the aseptic air flow barrier is further promoted.

The invention also relates to an apparatus for carrying out the method. The apparatus comprises supply means for supplying said gas or gas mixture as at least one flow into the package via the opening in the package, the supply means being adapted to supply at least one flow into and to the inner region of the package, which flow is thereafter returning back through the opening, and a delimited space adapted to be positioned outside the opening for temporarily catching the return flow from the package, and directing means for directing the return flow out from the space in such a way that a substantially vertical flow along the outer envelope surface of the package is formed.

BRIEF DESCRIPTION OF THE ACCOMPANYING DRAWINGS

The present invention will now be described in greater detail hereinbelow, with reference to two embodiments shown on the accompanying schematic drawings. In the drawings.

DETAILED DESCRIPTION OF THE INVENTION

Figure 1:
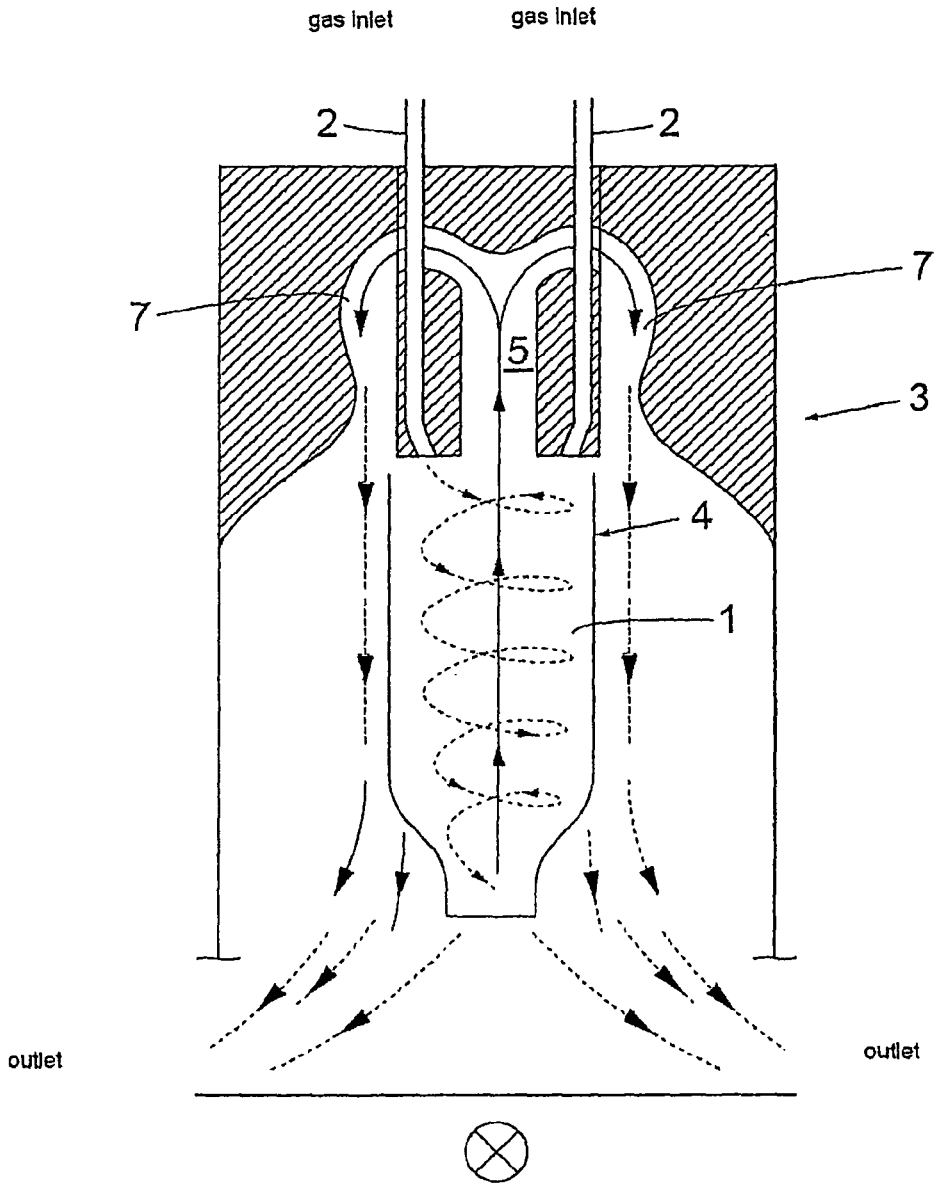
FIG. 1 is a cross sectional view of a first embodiment of an apparatus according to the invention as an explicit illustration of the function of the invention.

The cross sectional view illustrated in FIG. 1 shows the function of the invention according to a first embodiment. A package 1 in a sequence of exactly identical packages and with, in this case, an open bottom runs along a belt for the progressive indexing of, for example, four packages 1 at a time in the machine direction MD. Those stages which a package thereby passes through are, on the one hand, a stage during which it is aspirated with air heated to about 150° C. for heating to about 70° C., and a stage for sterilisation of the package, during which stage it is aspirated with gaseous hydrogen peroxide, or other sterilisation gas, and finally a stage for ventilation of the package by aspiration with sterile air. Once these stages have been passed through, filling takes place followed by final sealing of each respective package 1. Regardless of whether it is hot air, sterilisation gas or sterile ventilation air which is supplied in the supply channels 2 illustrated in FIG. 1 in an apparatus 3 according to the invention, it may be ascertained that the flow which results in that the supply channels 2 are, in their lower ends, angled in such a manner that they make an angle of less than 8° to both of the planes of symmetry which display the symmetry axis which intersects the opening of the package at a right angle as a common line, thus directed slightly peripherally as well as slightly towards the centre of the package imparts the best conceivable vortex helical form to the gas flow angled down in the package on its way down. In order moreover, in connection with gas being supplied to achieve the best possible flow distribution all the way down in the least readily accessible nooks down in the "bottom" of the package 1, the number of supply channels 2 should, as experiments have also demonstrated, be adapted to the volume of the packages or their circumference in association with the open end of the packages. In the embodiment illustrated here, the apparatus includes ten channels 2 uniformly distributed along the upper region of the described apparatus 3. It is once again worthy of pointing out that the experiments which have been carried out with water as a trial medium have demonstrated that the medium which is fed via the channels 2 for gas in this configuration will flow out of the package as a quite central flow upwards in the package 1 in order, at its upper region 4, to be able to flow into a space in the form of a central return channel 5. The return channel 5 is, from the flow of viewpoint, designed so that the incoming flow thereto is to meet the least possible counter pressure. The flow in the return channel 5 is deflected by directing means in the form of divided channels 7 communicating with the central channel 5. The channels are formed so that the flow is forced to change direction through 180° and thereafter be led past also the outside of the package 1 in order to improve the sterilisation thereof, and in such instance, depending upon the quantity of supplied gas, to realise the desired effect either in the form of improved heating or better being able to guarantee the aseptic zone on the package 1.

Figure 2:
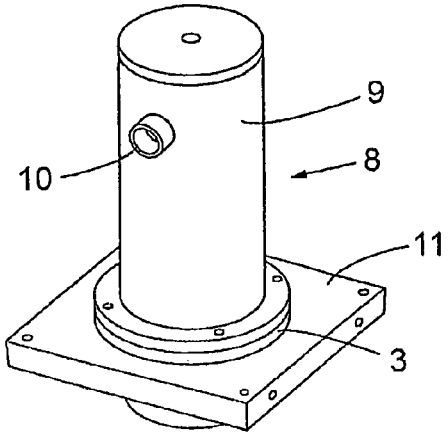
FIG. 2 is an isometric view of the first embodiment of an actual apparatus according to the present invention.
Figure 3:
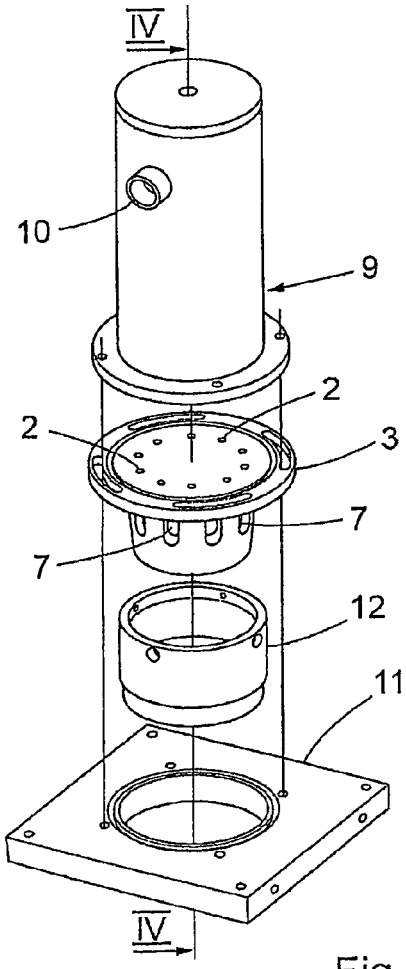
FIG. 3 is an isometric exploded view of the same apparatus.

FIG. 2 shows a gassing assembly 8 comprising an apparatus 3 according to a first embodiment of the invention in an integrated composite state with the assembly 8. The assembly 8 has an inlet chamber 9 with a central gas inlet connection 10 and a plate 11 for fixing of the assembly to a filling machine (not shown). In association with FIG. 2, FIG. 3 is a perspective exploded view of the assembly 8. Thus, the apparatus 3 is also shown here in perspective, for which reason its various component parts, above all the supply channels 2 and the directing channels 7 deflecting the gas mass flow are clearly apparent. The fact that the number of channels 2 in the illustrated embodiment is ten is pure circumstance and appears to be, of the experimental results obtained hitherto, dependent upon diameter for achieving an optimum flow pattern. FIG. 3 similarly shows a cylindrical conductor sleeve 12 which, in the composed state of the assembly 8, is intended to surround the outer circumferential surface of the apparatus 3.

Figure 4:
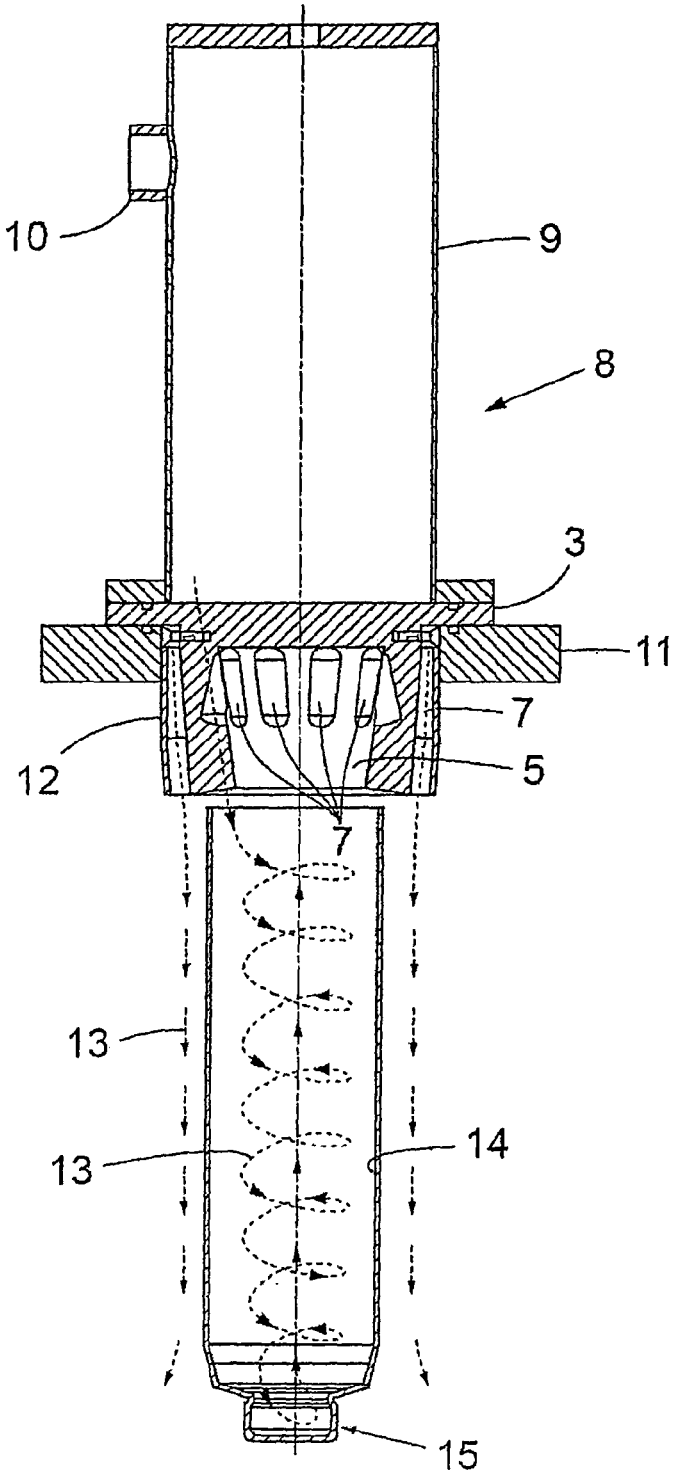
FIG. 4 is a cross section from IV-IV in FIG. 3 through the apparatus in question with a package intended for sterilisation disposed therebeneath.

FIG. 4 shows the assembly 8 as a central cross section in a position corresponding to that which the assembly 8 may have when it is run in production. With a view to making a comparison with FIG. 1 possible, this figure shows an imaginary flow pattern corresponding to that which is illustrated in the fundamental outline drawing in FIG. 1.

A brief description will be given below of the fundamental operation of the apparatus. Supply with gas of the desired type (hot air, sterilisation gas or sterile air or combinations thereof) takes place continuously at the central inflow connection 10. In that the supplied gas first fills the inflow chamber 9, the flow which is fed to the package 1 via the channels 2 will be able to maintain a uniform and constant pressure, which must be considered as a precondition for the function of the assembly 8 to maintain a continuous gas mass flow. The channels 2 are obliquely inclined in the above described manner (less than 8° in relation to two mutually right angled planes of symmetry) thereby gives rise to a helical gas mass flow along the inner periphery of the package. When the gas mass flow reaches the bottom 15 of the package 1, it will, as a consequence of the lower gas pressure in the centre of the package, strive to leave the package in this section. Thus, the return flow of the supplied gas out of the package also takes place in a controlled manner. When the return flow reaches the opening of the package, it is taken care of in the return channel 5. In the upper region of the return channel this is deflected approx. 180° in order to be led out via the outer periphery of the package. There will thereby be created a downwardly directed flow stratum along the circumferential surface of the package 1, which, when the gas consists of sterilisation gas, sterilises this surface and principally protects against re-infection. Since the velocity of the gas mass flow, as was mentioned by way of introduction, according to the invention is but a fraction of the previously employed velocity, the return flow flows as a boundary layer flow downwardly directed along the outside of the package. Hereby, the downwardly directed flow in the treatment chamber will no longer constitute a potential risk for turbulent currents occurring in the interface region beneath the package, for which reason the gases in the aseptic chamber will, thanks to the assembly 8, be able to be put to better utilisation and will be able to be taken care and reused in a simpler manner. Further, the potential risk of re-infection of the package in the subsequent filling stage according to the prior art technology will be obviated since the constant sterile air flow which prevails there no longer runs the risk of being disturbed by the gas mass flows in the sterilisation stage.

Figure 5:
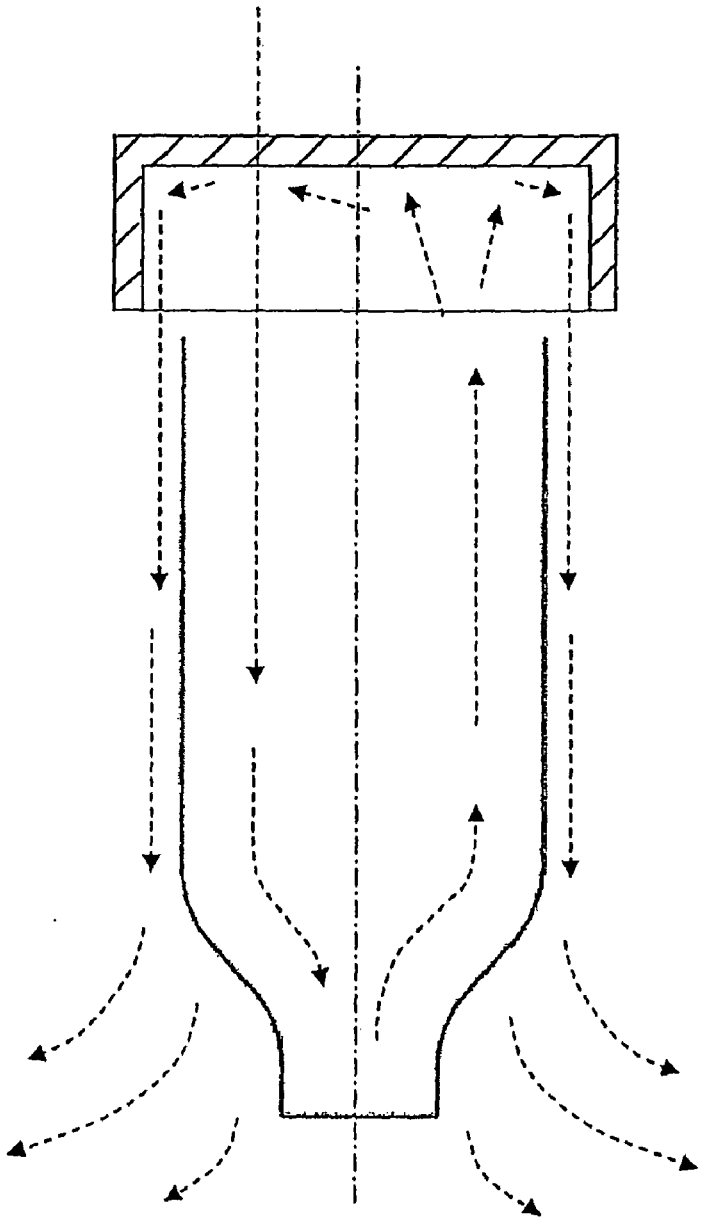
FIG. 5 is a cross sectional view of a second embodiment of the apparatus according the invention.

FIG. 5 shows a simplified cross sectional view of a second embodiment of the invention and a package 1. In this embodiment the gas or gas mixture is supplied with a vertical flow into the package 1. Preferably, the flow is supplied at a distance offset the centre of the package 1. The supply means is not shown in the figure, but is represented by the flow arrow F. The supply means may for example be a conventional jet nozzle or other supply nozzle.

The return flow, which in this case does not comprise a well-defined, centred flow, but an asymmetric one, is temporarily caught in a space delimited by a cup-shaped device 16. The upper, centre portion of the device 16 may comprise the supply means or constitute the supply means. The device 16 also comprises a sleeve 18. The return flow will hit the inside of the cup-formed device, mostly near or in the centre of it. The flow will continue first outwards along the inside top surface of the device 16 and then along directing means in the form of the inner envelope surface of the sleeve 18. The directing means 18 will make the return flow form a substantially vertical flow along the outer envelope surface of the package 1. In the presently preferred example shown the cup-formed device 16 is circular and the diameter is larger than the diameter of the package 1 near the opening. In this way there is formed a straight passage for the flow from the inside of the sleeve 18 and down along the outside of the package 1. Preferably, there is also a distance between the cup-shaped device 16 and the package 1 in the direction along the centre axis of the package 1.

This second embodiment may preferably be used in the heating stage, but may also be used in the sterilisation stage and the ventilation stage.

Although the present invention has been described with respect to presently preferred embodiments, it is to be understood that various modifications and changes may be made without departing from the object and scope of the invention as defined in the appended claims.

The invention claimed is:

1. In an apparatus in a filling machine, a method of supplying gas or gas mixture to the inside of partly formed packages before a subsequent filling and sealing of the packages, the method comprising:

supplying said gas or gas mixture as at least one flow into the package via an opening in the package, the supply being made such that the at least one flow flows into the package to an inner region of the package and thereafter returns as a return flow back through the opening, and temporarily catching return flow from the package in a delimited space outside the opening, and directing the return flow out from the delimited space via divided channels in which the return flow is rotated about 180°, divided positively and directed out from the delimited space in such a way that the average direction of the entire directed return flow is substantially vertical along the outer envelope surface of the package, wherein the gas is supplied through supply channels which are obliquely inclined to thereby give rise to a helical gas mass flow along the inner periphery of the package, and the delimited space is formed as a central return channel which is in communication with the divided channels.

2. The method as claimed in claim 1, wherein the interior of the packages is progressively initially supplied via the open end of each package, with a hot air flow, thereafter a gaseous flow of a sterilisation agent, and finally a sterile air flow.

3. The method as claimed in claim 1, wherein a gaseous sterilisation agent is progressively admixed to the initially supplied hot air gas flow in a machine direction.

4. The method as claimed in claim 1, wherein the supply channels are angled so that a direction of flow falls outside both of planes of symmetry which have an axis of symmetry which at right angles intersects the opening of the package as a common line.

5. The method as claimed in claim 4, wherein the supply channels are angled less than or equal to 8° in each direction.

6. The method as claimed in claim 1, wherein the flow of the gas or the gas mixture is maintained continuously over time.

7. An apparatus in a filling machine for supplying gas or gas mixtures to an inside of packages in association with an opening thereof before a later filling and sealing of the packages, the apparatus comprising:

supply means for supplying said gas or gas mixture as at least one flow into the package via the opening in the package, the supply means being adapted to supply at least one flow into and to an inner region of the package, which flow is thereafter returning as a return flow back through the opening, a delimited space adapted to be positioned outside the opening for temporarily catching the return flow from the package, and directing means for directing the return flow out from the delimited space, the directing means having the form of divided channels for turning the return flow through 180°, dividing it positively and directing it out from the delimited space in such a way that the average direction of the entire directed return flow is substantially vertical along an outer circumferential surface of the package, wherein the supply means comprises supply channels which are obliquely inclined to thereby give rise to a helical gas mass flow along the inner periphery of the package, and the delimited space is formed as a central return channel which is in communication with the divided channels.

8. The apparatus as claimed in claim 7, wherein the supply channels are angled so that a direction of the flow falls outside planes which are parallel with any of the planes of symmetry which have the axis of symmetry which intersects the opening of the package as a common line, and are thus directed in a first direction somewhat peripherally and in a second direction slightly towards the centre of the package.

9. The apparatus as claimed in claim 8, wherein the angling of the supply channels is less than or equal to 8° in each direction.

10. The apparatus as claimed in claim 7, wherein the supply channels and the central return channel are designed so that a downwardly directed part of the gas mass flow is self-inhibiting for the formation of a vertical one-way flow in the absence of a package.

11. The apparatus as claimed in claim 7, wherein an underside of the apparatus is adapted configurationally to the configuration of the package which is intended to be sterilised.

* * * * *